US005247232A

United States Patent [19]

Lin

[11] Patent Number: 5,247,232

[45] Date of Patent: Sep. 21, 1993

[54] AUTOMATIC GARAGE DOOR CONTROL DEVICE

[76] Inventor: Chii C. Lin, 2700 N. Shannon Ave., Bethany, Okla. 73008

[21] Appl. No.: 832,797

[22] Filed: Feb. 7, 1992

[51] Int. Cl.[5] ..... E05F 15/20

[52] U.S. Cl. ..... 318/468; 318/266; 318/286

[58] Field of Search ..... 318/264, 265, 266, 267, 318/283, 286, 452, 466, 467, 468, 469, 470, 480; 340/541; 250/206.1; 49/25, 26, 29, 30, 31

[56] References Cited

U.S. PATENT DOCUMENTS 3,742,434 6/1973 Leyde et al. .
3,868,000 2/1975 Spear et al. .
4,274,226 6/1981 Evans ..... 49/25
4,404,558 9/1983 Yen ..... 340/825.72
4,429,264 1/1984 Richmond ..... 318/446
4,549,092 10/1985 Matsuoka et al. ..... 307/116
4,713,591 12/1987 McCloskey ..... 318/257
4,736,144 4/1988 Chun-Pu ..... 318/467
4,843,639 6/1989 Beals ..... 455/603
4,922,168 5/1990 Waggamon et al. ..... 318/286

*Primary Examiner*—Bentsu Ro
*Attorney, Agent, or Firm*—Dougherty, Hessin, Beavers & Gilbert

[57] ABSTRACT

A garage door control device that will automatically open or close depending upon conditions, the device having a motion detector responsive to vehicle space for actuating security lighting and warning measures, and a sound detector coacting with the motion detector and a garage entry door sensor to provide enablement of the door closure activator during respective exiting and non-exiting modes.

7 Claims, 2 Drawing Sheets

AUTOMATIC GARAGE DOOR CONTROL DEVICE

BACKGROUND OF THE INVENTION

1. Field of the Invention.

This invention relates to powered overhead garage doors, and in particular to a system that will automatically open or close the garage door at the appropriate time and ensure that the garage door will not be inadvertently left open for any reason.

2. Description of the Prior Art

Powered overhead garage doors, equipped with an electric motor to open or close the door by radio control units (receiver and transmitter), or by pushbutton switch on the garage wall, have gained popularity over the past decade. While the system works quite satisfactorily for some time, there are problems of unintentional opening by stray radio signal, or by electromagnetic storms, or by electrical power fluctuations. The problem occurs probably more often when the driver simply forgets to depress the control button to close the garage door because of an emergency he has to attend to, or the traffic on the street he is backing into, or a minor illness, or simply because of the joy of getting home after a stressful day at work.

The need of an automatic garage door control device is evidenced by the numerous patents issued in this field. Some current U.S. Patents in this area include U.S. Pat. Nos. 4,035,702; 4,364,003; and 4,463,292. These proposals attempt to close the garage door after it has been opened for a selected time interval either by mechanical or electronic means.

SUMMARY OF THE INVENTION

The primary object of this invention is to provide automatic control for powered overhead garage doors. Another object is to provide security lighting for the driveway when motion of vehicle or other objects is detected. Yet another object is to provide a warning signal shortly before the garage door begins to close.

For the accomplishment of the above and related objects, the device employs a one-shot timer that may be activated to energize a relay that, in turn, activates the garage door control unit to open or close the garage door. When a vehicle exits the garage, a motion detector and a delay timer will signal the activating timer to close the garage door. After a vehicle has entered the garage, a sound detector and/or a door switch will signal the activating timer to close the garage door. Any other situations that cause the garage door to open are effected by an oscillator that produces a signal every two or so minutes to cause the garage door to close if it remains open for whatever reason.

DETAILED DESCRIPTION OF THE PREFERRED EMBODIMENT

Figure 1:
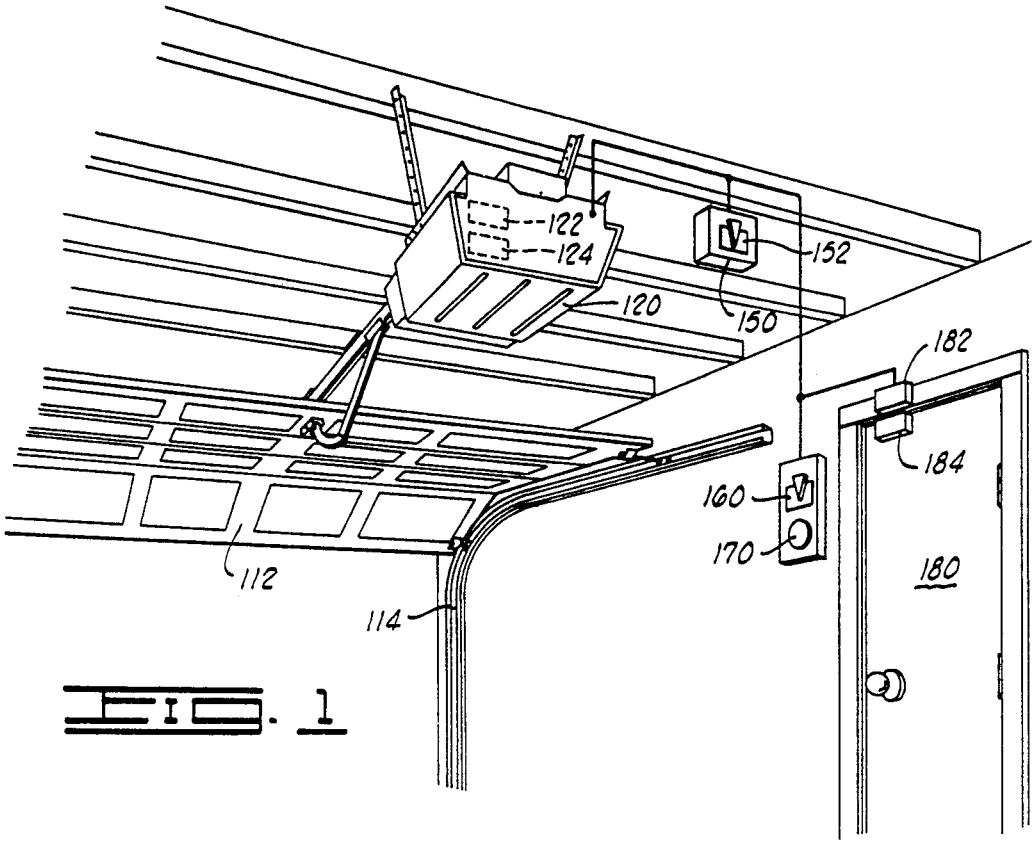
FIG. 1 is a perspective view of a well-known type of powered overhead garage door incorporated with an automatic control device.

A powered overhead garage door with automatic control device is illustrated in FIG. 1. The garage door 112 is mounted for rolling movement on opposite side tracks 114 so that it can be raised or lowered by an electric powered control unit 120 through mechanical connections (chain, etc.). Limit switches 122, 124 are provided inside the control unit 120 for correct setting of proper limits of down (close) or up (open) position of the garage door 112. A wall pushbutton 170 is usually mounted in a location near the service entrance door 180 for manual control of the control unit 120. Such a garage door installation is typified by the Sears unit, Model 139.655000.

The main part of the present invention is contained in the control box 150, which can be incorporated into the control unit 120 in future manufactures. A mode switch 152 is available to select either one of the two modes in which the device can be operated. A disable switch 160 is provided for the purpose of disconnecting the automatic function when the garage door 112 is going to remain open for a longer period of time. A door switch 182, a normally open proximity switch, and a magnetic actuator 184 are mounted on the frame and door of the service entrance 180, respectively, to perform the function of the wall pushbutton 170. Door switch 182 is closed momentarily when the service entrance door 180 is opened.

Figure 2:
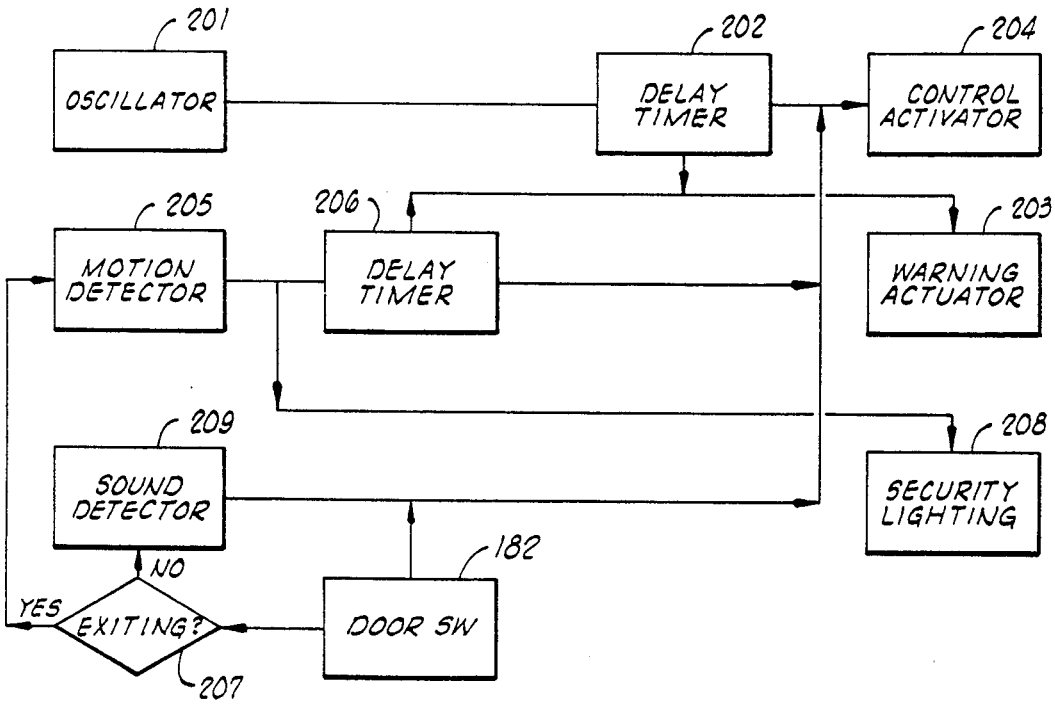
FIG. 2 is a functional block diagram showing the conceptual configuration of the device.

FIG. 2 is a functional block diagram of the automatic control device. Oscillator 201 will initiate a trigger to energize delay timer 202 at a pre-set rate. Delay timer 202 will then activate a warning actuator 203 and, at the end of the timing cycle, it will energize control activator 204 to signal the control unit 120 (FIG. 1) to close the garage door 112. This function is designed to provide for unintentional opening of the garage door 112 or malfunction of other operations.

The door switch 182 provides an actuation output to a decision stage 207 to test the door condition. If exiting, an output is provided to motion detector 205 and motion detector 205 functions to detect movement of a vehicle in the driveway after exiting the garage to cause delay timer 206 to energize. Delay timer 206 will energize warning activator 203, and then energize control activator 204 to signal the control unit 120 to close garage door 112 if decision stage 207 signifies affirmative. Actually stage 207 is a one-shot as described further relative to FIG. 3. Motion detector 205 will also serve as security lighting control to turn on driveway security lighting 208 for a selected time period whenever motion is detected in the driveway area.

If decision stage 207 shows negative, then sound detector 209 can respond to a loud sound such as slamming shut of the vehicle doors, and door switch 182 will detect the opening of the service entrance door 180. Either of these signals from sound detector 208 or door switch 182 are output to the control activator 204 in control unit 120 to close the garage door 112 as decision stage 207 indicates "no exit".

Figure 3:
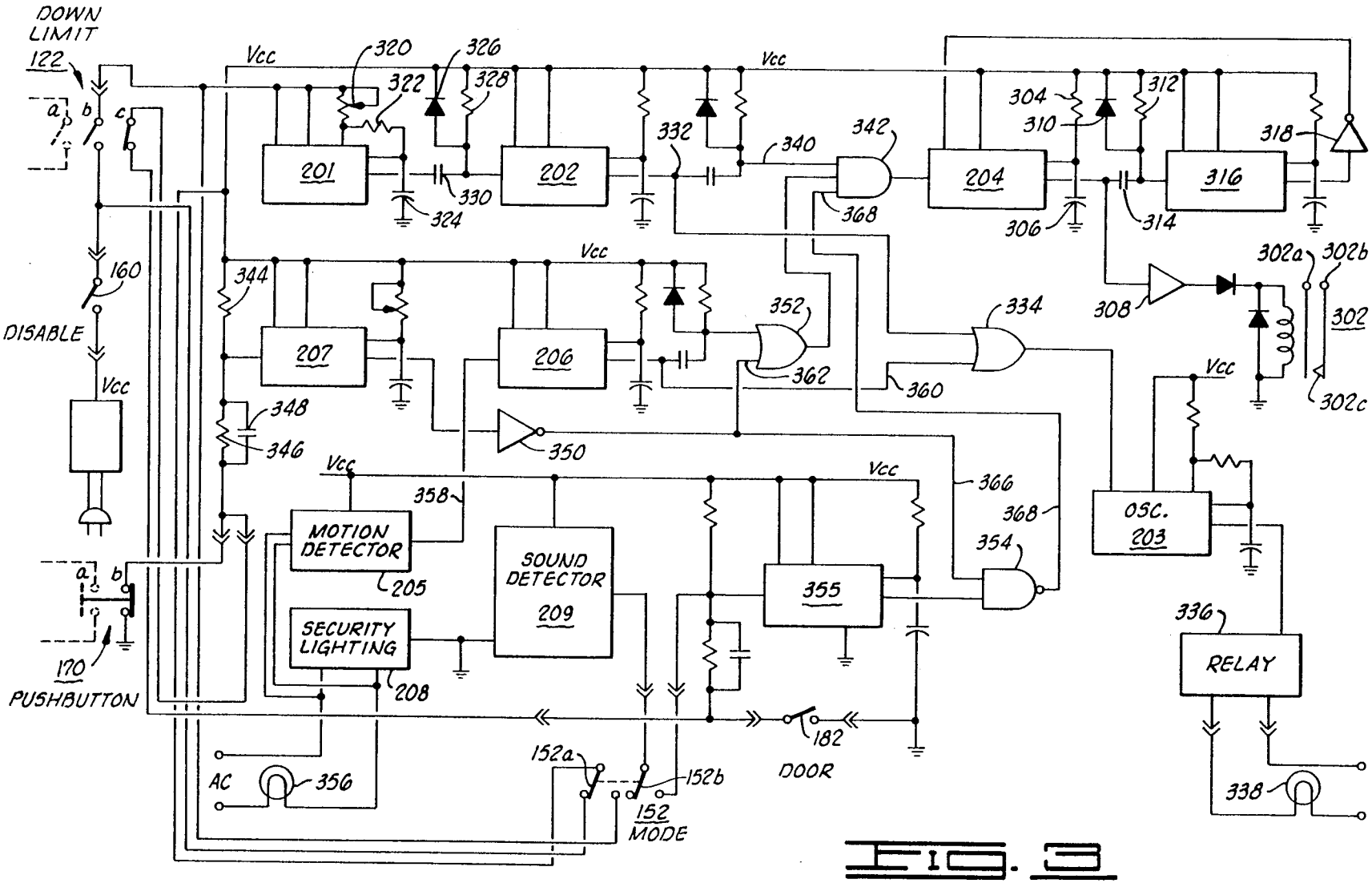
FIG. 3 is a schematic diagram of the automatic garage door control device.

Referring to FIG. 3, relay 302 provides communication between the control unit 120 and the automatic control box 150. Relay contact 302 automates the wall pushbutton 170 function. Relay terminals **302*a* and 302*b* are then connected to control unit 120 at the same terminals as the wall pushbutton 170**.

One-shot timer 204 (the control activator of FIG. 2), with resistor 304 and capacitor 306 as its timing circuit, serves to energize the relay 302 via amplifier 308 to enable proper operation of the control unit 120. The circuit comprised of diode 310, resistor 312 and capacitor 314 will create a trigger to one-shot timer 316 when one-shot timer 204 de-energizes. One-shot timer 316 is then energized for about 10 seconds and provides a LOW, through invertor 318, to the reset of one-shot timer 204. This LOW inhibits any other triggering of the one-shot timer 204 that might cause a reversal of the garage door 112 movement.

Oscillator 201 (see also FIG. 2), with resistors 320 and 322 and capacitor 324 as its timing circuit, will produce a LOW going pulse every couple of minutes. The trigger forming circuit comprised of diode 326, resistor 328 and capacitor 330 will trigger delay timer 202 when oscillator 201 de-energizes. The trigger circuit output at junction 332 is used repeatedly in this device, as will be further described. When delay timer 202 energizes, OR gate 334 will have a HI output and enable warning oscillator 203 to conduct through a relay 336 and flash a warning device 338. Warning device 338 can be either a siren or a red light installed on the garage wall. When delay timer 202 de-energizes, a trigger will be present at the input lead 340 of AND gate 342 to cause oneshot timer 204, the control activator, to energize the control unit 120 (FIG. 1) via relay terminals 302*a* and 302*b*.

A one-shot timer 207 is employed logically to differentiate between the entering and exiting operations. When exiting the garage, the wall pushbutton 170 (see FIG. 1) is depressed and will cause contact 170*a* (replacing the old pushbutton contact) to close and contact 170*b* to open. This will open the garage door in the usual manner. When the depression of the wall pushbutton 170 is released, contact 170*b* will be closed and create a triggering signal through resistors 344 and 346 and capacitor 348 to energize the exiting one-shot timer 207. When one-shot timer 207 is energized, invertor 350 and OR gate 352 will enable the passage of negative going trigger originating from motion detector 205; and, invertor 350 and NAND gate 354 will disable the passage of trigger originating from sound detector 209 or door switch 182 (see FIG. 2). When a vehicle is entering the garage, a one-shot timer 355 is de-energized and the logical enabling status is reversed.

Motion detector 205 employs a passive infra red sensor to detect motion of an infrared radiating object within the covered area. Such devices are used in home security alarm systems and particularly in motion-activated security lighting for driveways. When motion is detected, the security light 356 will be turned ON for a selected period of time; and, a negative going signal on lead 358 will trigger one-shot delay timer 206. The delay timer 206 will then cause OR gate 334 to output a HI to enable the warning actuator oscillator 203 to actuate the warning alarm. At the end of the delay timing cycle, a negative trigger will pass via lead 360 through OR gate 334 and AND gate 342 to activate the control unit 120 (FIG. 1) so long as the OR gate 352 is enabled by a LOW at the input 362 due to the energizing of one-shot timer 207.

Sound detector 209 will detect a loud sound such as slamming shut of the vehicle doors and output a negative-going signal to trigger one-shot timer 355 if mode switch contact 152*b* is closed. The one-shot timer 355 will then output a positive-going pulse to NAND gate 354 which, if enabled by a HI in the input lead 366, will produce a negative-going pulse on lead 368 to AND gate 342 to cause the control unit 120 to close the garage door 112. Door switch 182 (FIG. 1) functions as a source of signal similar to the sound detector 209 just described. It also serves to perform the function of the wall pushbutton 170 through DOWN limit switch contact 122*c*.

Mode switch 152 is a ganged, double-pole/double-throw switch. Contact 152*a* connects the Vcc buss to the power supply while contact 152*b* disconnects the function of the sound detector 209 in the mode shown in the schematic. In the other mode, contact 152*a* connects Vcc to the upper terminal of DOWN limit switch 122*b* and contact 152*b* connects the sound detector 209 to one-shot timer 355. In this mode, the power to the device is turned on only when the garage door 112 is open. This is achieved by an alternate to DOWN limit switch 122. That is, switch contact 122*a* functionally replaces the old down limit switch contact to turn OFF the door drive motor when the garage door 112 reaches its fully closed position. Contact 122*b* functions to turn OFF the power to the automatic control device and contact 122*c* connects door switch 182 to the trigger forming circuit comprised of resistor 346 and capacitor 348 when the garage door 112 is closed. The connection of contact 122*c* is useful only when the device is operated in the continuous powered mode (contact 152*a* closed). In this mode, the opening of service entrance door 180 (FIG. 1) will cause the garage door 112 to open, and one-shot timer 207 to energize in the same manner as when depressing the wall pushbutton 170. Disable switch 160 is provided for the purpose of disconnecting the automatic control function from the control unit 120.

All oscillator and logic switching circuits 201, 202, 203, 204, 206, 207, 316 and 355 may be accomplished with conventional one-shot multi-vibrator circuitry. For example, in current design the one-shot circuits are IC type 555; however, there are a number of equivalent or specialized integrated circuits that may be utilized.

Changes may be made in the combination and arrangement of elements as heretofore set forth in the specification and shown in the drawing; it being understood that changes may be made in the embodiments disclosed without departing from the spirit and scope of the invention.

What is claimed is:

1. An automatic control device for powered garage door, comprising:

control relay means actuatable to closed position to enable said garage door to open and close;

control activating means energizable to provide an electrical signal output to actuate said control relay means;

a safety warning device;

oscillator and delay timer means for providing a first output pulse to enable the operation of the safety warning device, and a second output pulse to energize said control activating means; and motion detection and delay timer means for detecting exit of a vehicle and producing a third output pulse for enabling the operation of the safety warning device, and for producing a fourth output pulse to energize said control activating means, and to produce a signal to energize security lighting.

2. An automatic control device as set forth in claim 1 which is further characterized to include:

sound detection means for detecting a door shutting and generating a fifth output pulse to energize the control activating means.

3. An automatic control device as set forth in claim 2 which is further characterized to include:

service door switch means producing a service door open output pulse to energize the control activating means.

4. An automatic control device in accordance with claim 3 wherein said sound detection means further includes:

a sound detector responsive to loud sound of shutting the vehicle door;

pulse forming means to accept signals from said sound detector or said door switch means and to output trigger signal to said control activating means.

5. An automatic control device as set forth in claim 1 which is further characterized to include:

service door switch means producing a service door open output pulse to energize the control activating means.

6. An automatic control device as set forth in claim 1 wherein said control activating means further includes:

a first one-shot timer to provide a signal of selected duration to energize said powered garage door; and a second one-shot means with invertor to inhibit further energization of said first one-shot timer for a predetermined period to allow garage door movement to complete an open/closed cycle.

7. An automatic control device in accordance with claim 1 wherein said safety warning device further comprises:

controlled oscillator means responsive to said delay timer means first output pulse for providing an output signal;

a solid state AC relay responsive to said output signal from said controlled oscillator means to operate a warning means.

* * * * *